US010933264B1

(12) United States Patent
Strouse et al.

(10) Patent No.: US 10,933,264 B1
(45) Date of Patent: Mar. 2, 2021

(54) PORTABLE FIRE SAFETY ENCLOSURE SYSTEM

(71) Applicants: Christopher Strouse, Roseto, PA (US); Krista Strouse, Roseto, PA (US)

(72) Inventors: Christopher Strouse, Roseto, PA (US); Krista Strouse, Roseto, PA (US)

( * ) Notice: Subject to any disclaimer, the term of this patent is extended or adjusted under 35 U.S.C. 154(b) by 120 days.

(21) Appl. No.: 16/378,835

(22) Filed: Apr. 9, 2019

(51) Int. Cl.

| | |
|---|---|
| ***A62C 15/00*** | (2006.01) |
| ***A62B 17/00*** | (2006.01) |
| ***A62C 2/06*** | (2006.01) |
| *A62B 7/02* | (2006.01) |
| *A45F 3/00* | (2006.01) |
| *A62B 5/00* | (2006.01) |

(52) U.S. Cl.
CPC ..... *A62C 15/00* (2013.01); *A62C 2/06* (2013.01); *A45F 2003/003* (2013.01); *A62B 5/00* (2013.01); *A62B 7/02* (2013.01)

(58) Field of Classification Search
CPC ..... A62C 15/00; A62C 2/06; A62B 17/003; A62B 5/00; A62B 7/02; A45F 2003/003; A45F 3/04
USPC ..... 169/48; 135/98, 19.5; 224/576, 153, 224/154, 186, 190; 239/154
See application file for complete search history.

(56) References Cited

U.S. PATENT DOCUMENTS

| | | | | |
|---|---|---|---|---|
| 2,632,163 | A | 3/1953 | Ludwig | |
| 2,676,319 | A | 4/1954 | Davidson | |
| 3,802,511 | A * | 4/1974 | Good, Jr. | B05B 9/0855 169/30 |
| 5,027,810 | A | 7/1991 | Patureau | |
| 5,341,973 | A | 8/1994 | Dawes | |
| 5,628,066 | A | 5/1997 | Gottlieb | |
| 6,024,264 | A * | 2/2000 | Java | A45B 3/00 135/16 |
| 6,053,385 | A * | 4/2000 | Ward | A45B 11/00 224/153 |
| 8,276,680 | B2 * | 10/2012 | Bouthiette | A62B 99/00 169/44 |
| 8,556,141 | B1 * | 10/2013 | Ferraiolo | A45B 25/22 224/190 |
| 9,616,261 | B1 | 4/2017 | Rambert | |
| 2002/0139407 | A1 | 10/2002 | Spiteri | |
| 2008/0236589 | A1 | 10/2008 | Bronson | |
| 2014/0061273 | A1 * | 3/2014 | Bullivant | A45F 3/04 224/576 |
| 2014/0261597 | A1 * | 9/2014 | Lin | A45B 23/00 135/98 |

* cited by examiner

*Primary Examiner* — Justin M Larson
(74) *Attorney, Agent, or Firm* — Kyle A. Fletcher, Esq.

(57) ABSTRACT

The portable fire safety enclosure system comprises a backpack, a protective cover, an extinguisher, and a breathing apparatus. The backpack may be adapted to be worn by a user to protect the user while the user exits from a burning building. The protective cover may comprise a flame retardant umbrella coupled to a clear flame retardant curtain. The protective cover may be deployed from within the backpack to surround the user and to prevent contact with burning materials. The extinguisher may be activated to spray a fire-suppressing substance from a nozzle located on the top of the protective cover. The extinguisher may extinguish flames that prevent exit from the burning building. The breathing apparatus may be adapted to provide a breathable gas to the user.

16 Claims, 4 Drawing Sheets

PORTABLE FIRE SAFETY ENCLOSURE SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of personal fire safety, more specifically, a portable fire safety enclosure system.

SUMMARY OF INVENTION

The portable fire safety enclosure system comprises a backpack, a protective cover, an extinguisher, and a breathing apparatus. The backpack may be adapted to be worn by a user to protect the user while the user exits from a burning building. The protective cover may comprise a flame retardant umbrella coupled to a clear flame retardant curtain. The protective cover may be deployed from within the backpack to surround the user and to prevent contact with burning materials. The extinguisher may be activated to spray a fire-suppressing substance from a nozzle located on the top of the protective cover. The extinguisher may extinguish flames that prevent exit from the burning building. The breathing apparatus may be adapted to provide a breathable gas to the user.

An object of the invention is to provide a protective cover to protect a user from contact with burning material as the user exists a burning building.

Another object of the invention is to provide the user with a source of a breathable gas.

A further object of the invention is to provide an extinguisher to spray a fire-suppressing substance on flames that block the user's path Yet another object of the invention is to provide a protective cover, breathing apparatus, and extinguisher packaged in a backpack that may be donned when needed and to deploy the protective cover from within the backpack.

These together with additional objects, features and advantages of the portable fire safety enclosure system will be readily apparent to those of ordinary skill in the art upon reading the following detailed description of the presently preferred, but nonetheless illustrative, embodiments when taken in conjunction with the accompanying drawings.

In this respect, before explaining the current embodiments of the portable fire safety enclosure system in detail, it is to be understood that the portable fire safety enclosure system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable fire safety enclosure system.

It is therefore important that the claims be regarded as including such equivalent construction insofar as they do not depart from the spirit and scope of the portable fire safety enclosure system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
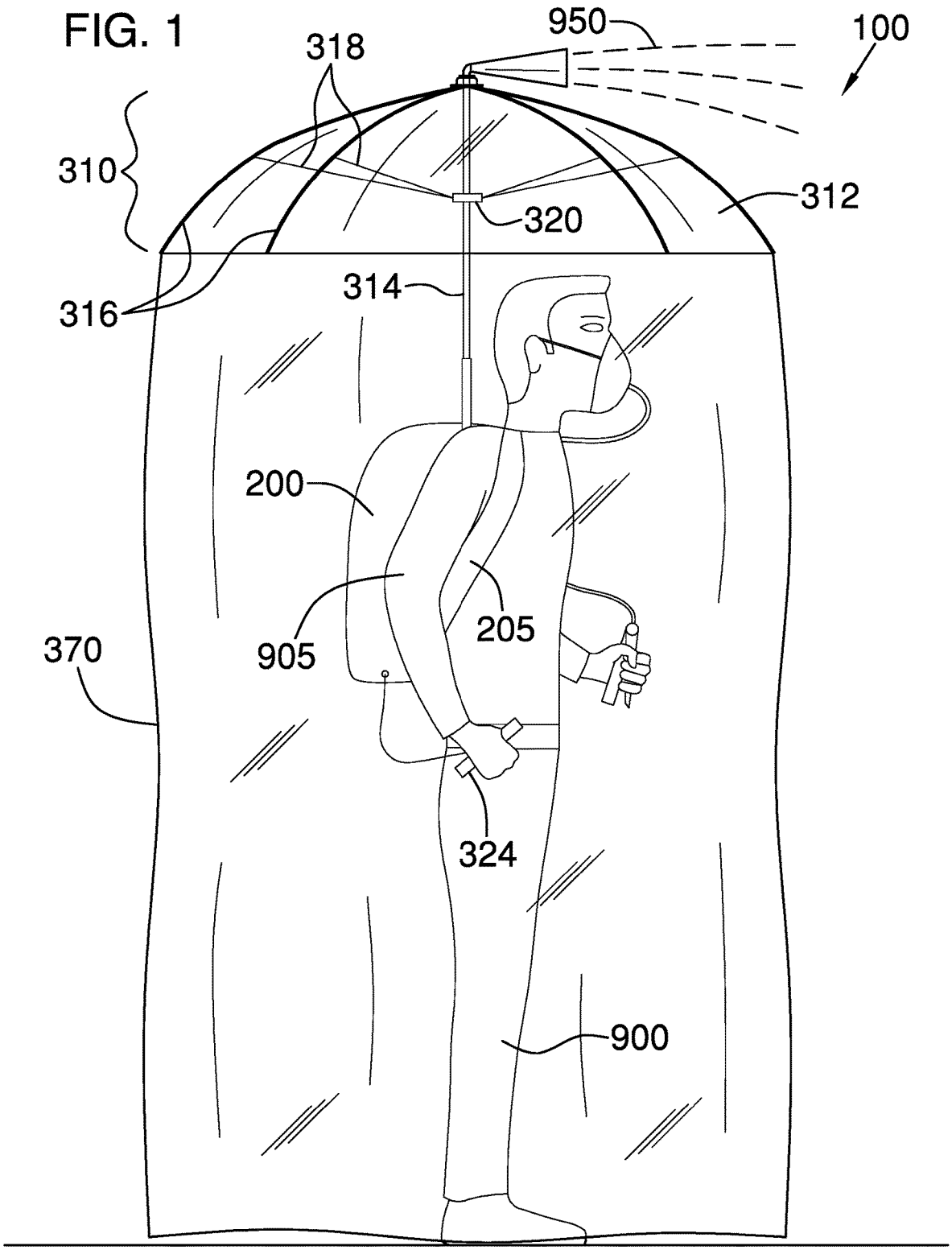
FIG. 1 is a right side view of an embodiment of the disclosure while in use.
Figure 2:
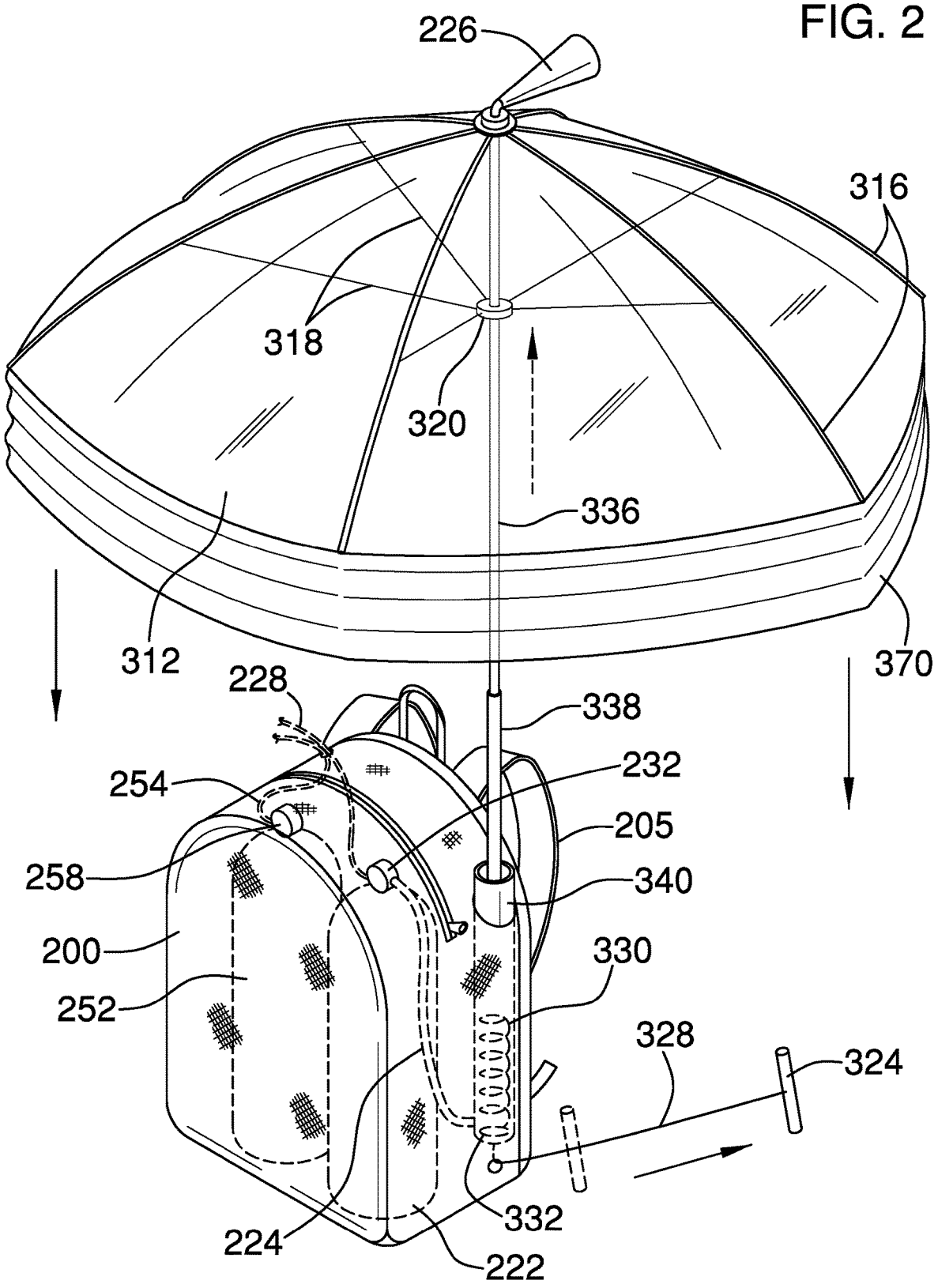
FIG. 2 is a perspective view of an embodiment of the disclosure.
Figure 3:
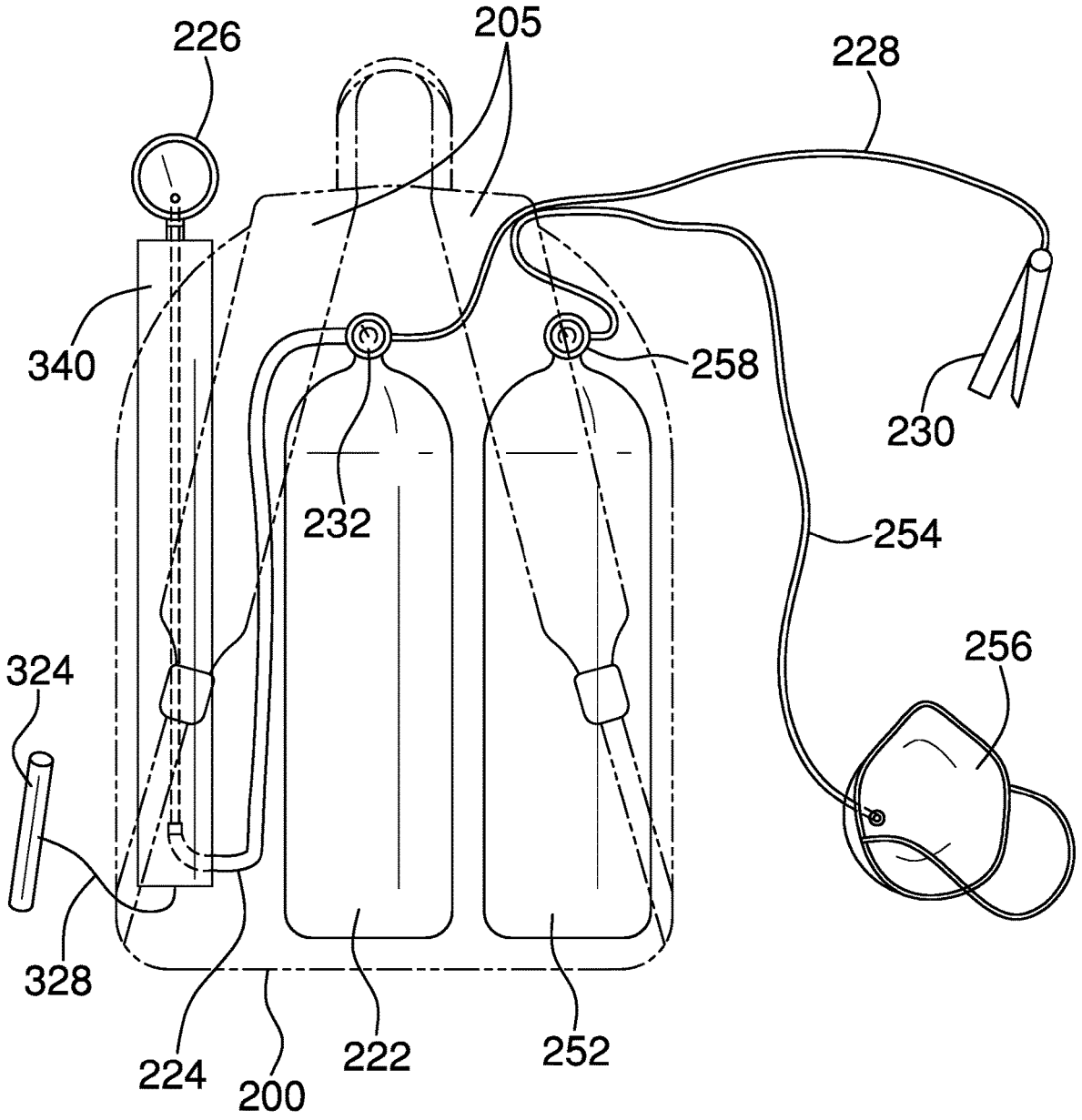
FIG. 3 is a rear view of an embodiment of the disclosure.
Figure 4:
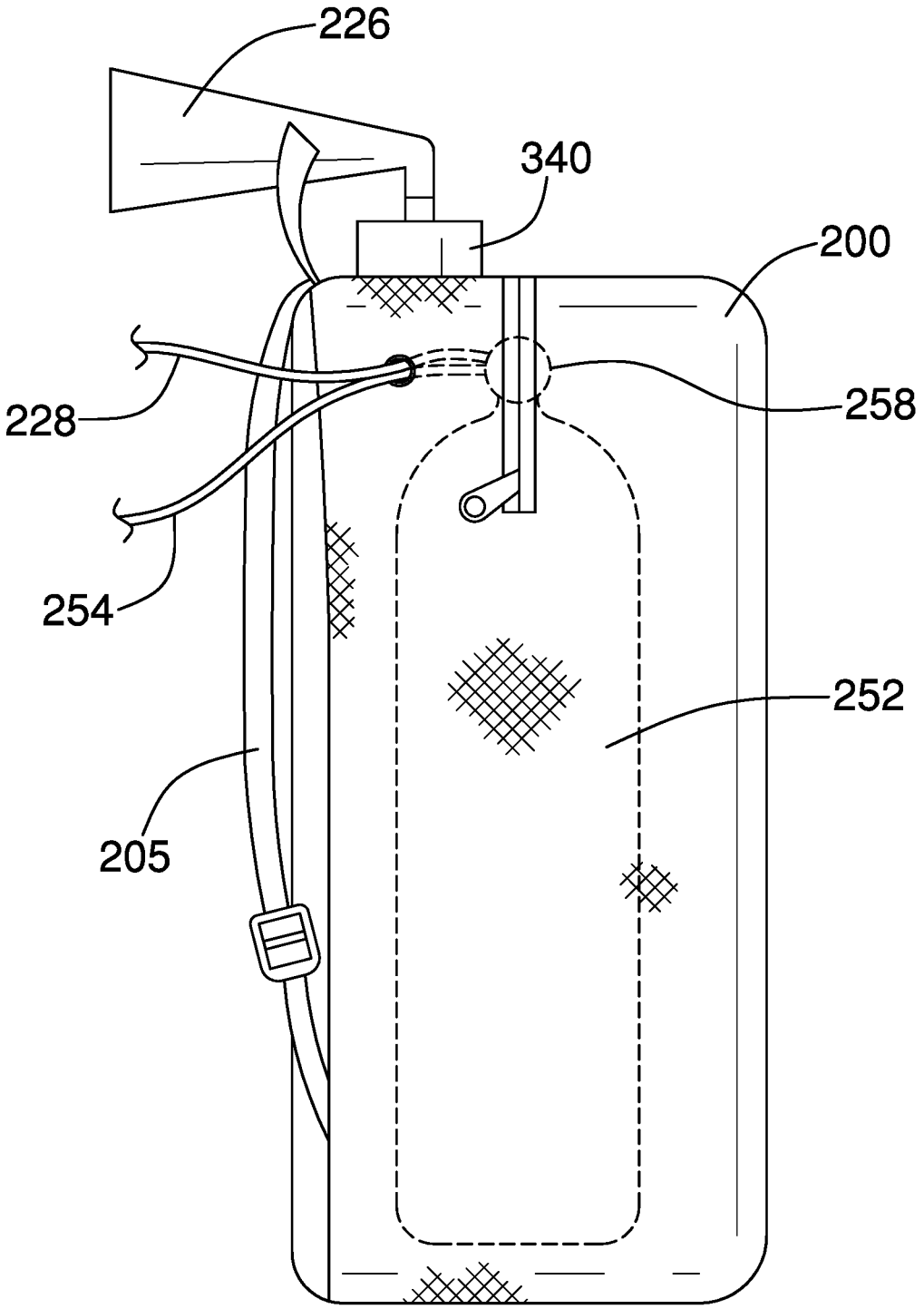
FIG. 4 is a left side view of an embodiment of the disclosure.

Detailed reference will now be made to a first potential embodiment of the disclosure, which is illustrated in FIGS. 1 through 4.

The portable fire safety enclosure system 100 (hereinafter invention) comprises a backpack 200, a protective cover, an extinguisher, and a breathing apparatus. The backpack 200 may be adapted to be worn by a user 900 to protect the user 900 while the user 900 exits a burning building. The protective cover may be deployed from within the backpack 200 to prevent contact with burning materials. The extinguisher may be activated to extinguish flames that prevent exit from the burning building. The breathing apparatus may be adapted to provide a breathable gas to the user 900.

The backpack 200 may be an enclosure for the protective cover, the extinguisher, and the breathing apparatus. The backpack 200 may be stored within a building where the user 900 may easily access the backpack 200. The backpack 200 may be adapted to be donned during a fire emergency. The backpack 200 may be adapted to be worn by sliding the user's arms 905 through a pair of straps 205 and allowing the backpack 200 to rest against the user's back. The pair of straps 205 may be coupled to the exterior of the backpack 200 on the rear of the backpack 200. One of the pair of straps 205 may couple to the top of the left rear side of the backpack 200 and to the bottom of the left rear side of the rear of the backpack 200. The other of the pair of straps 205 may couple to the top of the right rear side of the backpack 200 and to the bottom of the right rear side of the rear of the backpack 200.

The protective cover may comprise an umbrella 310, a curtain 370, and an umbrella housing 340. The protective cover may be adapted to reside within the backpack 200 until the user 900 deploys the protective cover my pulling a deployment handle 324. The protective cover may deploy by extending the umbrella 310 from the top of the backpack 200, opening the umbrella 310, and releasing the curtain 370. Once deployed, the protective cover may be adapted to surround the user 900 with a clear, protective shield.

The umbrella 310 may comprise a dome 312, a shaft 314, a plurality of ribs 316, a plurality of stretchers 318, and a runner 320. The umbrella 310 may be a collapsible canopy that is adapted to protect the user 900 from objects falling from above.

The shaft 314, the plurality of ribs 316, the plurality of stretchers 318, and the runner 320, may comprise a frame for the umbrella 310. The shaft 314 may be a vertically-oriented armature that elevates the dome 312 above the backpack 200. The shaft 314 may be telescoping such that the overall height of the shaft 314 may be reduced when a first section 336 of the shaft 314 slides into a second section 338 of the shaft 314. The plurality of ribs 316 may radiate outward horizontally from the top of the shaft 314 to support the dome 312. The plurality of ribs 316 may be hingedly coupled to the top of the shaft 314 and may be equally spaced around the shaft 314. Each of the plurality of ribs 316 may bend in a downward arc to give the dome 312 a concave shape when viewed from above the dome 312.

The runner 320 may be a ring that surrounds the shaft 314 and is free to slide up and down the shaft 314. The plurality of stretchers 318 may radiate outward from the runner 320. There may be one of the plurality of stretchers 318 for each of the plurality of ribs 316. Each of the plurality of stretchers 318 may be hingedly coupled to the runner 320 at one end and hingedly coupled to a midpoint one of the plurality of ribs 316 at the other end.

The dome 312 may be a circular sheet of material that couples to the outermost end of each of the plurality of ribs 316 around the periphery of the dome 312. The shaft 314 may pass through the center of the dome 312 and the dome 312 may be coupled to the top of the shaft 314 at that point.

The curtain 370 may be a sheet of material formed into a hollow, vertically-oriented tube that is open at the top and bottom of the tube. The top of the curtain 370 may be coupled to the periphery of the dome 312.

The dome 312 and the curtain 370 may be clear to provide a view of the outside of the invention 100 from within the invention 100. The dome 312 and the curtain 370 may be treated to make them flame retardant.

The umbrella housing 340 may be a cylindrical tube that is coupled to the inside of the backpack 200. The umbrella housing 340 may be vertically oriented with the top of the umbrella housing 340 extending out of the top of the backpack 200. The umbrella housing 340 may enclose the umbrella 310 and the curtain 370 when that are not deployed. Specifically, the curtain 370 may be rolled upwards until it is adjacent to the umbrella 310, the umbrella 310 may be collapsed by pressing down on the distal ends of the plurality of ribs 316 and sliding the runner 320 down the shaft 314, and the umbrella 310 with the curtain 370 may be pushed down into the umbrella housing 340.

In some embodiments, the umbrella 310 may comprise a deployment spring 330 and a deployment latch 332. The deployment spring 330 may cause the shaft 314 to elevate and may cause the dome 312 to open, thus deploying the umbrella 310. The deployment latch 332 may retain the umbrella 310 in the non-deployed position until the deployment latch 332 is actuated. The deployment latch 332 may be actuated by pulling a deployment cord 328 via the deployment handle 324.

As a non-limiting example, one end of the deployment spring 330 may be coupled to the runner 320, either directly or indirectly through a lifting armature, and the other end of the deployment spring 330 may be coupled to the interior of the umbrella housing 340 such that the deployment spring 330 may cause the runner 320 of the umbrella 310 to rise. The runner 320 may initially be located at the bottom of the shaft 314. As the runner 320 rises, the runner 320 may cause the umbrella 310 to open by pushing outwards against the plurality of stretchers 318. The deployment latch 332 may be located at the bottom of the umbrella housing 340 and may hold the shaft 314 down until the deployment latch 332 is released. The deployment cord 328 may pass through a side wall of the backpack 200 such that the deployment cord 328 extends from the interior of the backpack 200 to the exterior of the backpack 200. The interior end of the deployment cord 328 may be coupled to the deployment latch 332 and the exterior end of the deployment cord 328 may be coupled to the deployment handle 324 such that pulling the deployment cord 328 may release the deployment latch 332 and causes the shaft 314 to move upwards.

The extinguisher may comprise an extinguisher tank 222, an extinguisher hose 224, an extinguisher nozzle 226, an extinguisher trigger cable 228, and an extinguisher trigger 230. The extinguisher may discharge a fire-suppressing substance 950 through the extinguisher nozzle 226 when the extinguisher is activated using the extinguisher trigger 230.

The extinguisher tank 222 may be a container for the fire-suppressing substance 950. The extinguisher tank 222 may be carried within the backpack 200. The extinguisher hose 224 may couple to the extinguisher tank 222 via an extinguisher valve 232. The fire-suppressing substance 950 may be retained in the extinguisher tank 222 when the extinguisher valve 232 is closed and may flow out of the extinguisher tank 222 and through the extinguisher hose 224 when the extinguisher valve 232 is open. The extinguisher valve 232 may be opened by actuating the extinguisher trigger 230. The actuation of the extinguisher trigger 230 may be conveyed to the extinguisher valve 232 via the extinguisher trigger cable 228. The extinguisher nozzle 226 may be located on the top of the shaft 314 above the dome 312 and may be adapted to point forward such that when the fire-suppressing substance 950 is discharged the fire-suppressing substance 950 may extinguish flames in front of the user 900. The shaft 314 may be hollow and the extinguisher hose 224 may pass through the hollow center of the shaft 314. The fire-suppressing substance 950 from the extinguisher tank 222 may pass through the extinguisher hose 224 to reach the extinguisher nozzle 226 which is coupled to the top of the shaft 314.

The breathing apparatus may comprise an air tank 252, a pressure regulator 258, an air hose 254, and a face mask 256. The air tank 252 may be a container for the breathable gas. As non-limiting examples, the breathable gas may be compressed air or oxygen. The air tank 252 may be carried within the backpack 200. The pressure regulator 258 may couple to the air tank 252 and may be adapted to reduce the pressure of the breathable gas that is inside the air tank 252 to a lower pressure that is safe for the user 900 to breathe. The air hose 254 may deliver the breathable gas from the pressure regulator 258 to the face mask 256. The face mask 256 may be adapted to be placed over the nose and mouth of the user 900 such that the user 900 may breathe the breathable gas while leaving the burning building.

In use, the invention 100 may be stored within the building until it is needed. As non-limiting examples, the invention 100 may be stored in offices, bedrooms, closets, or stairwells. In the event of a fire emergency, the user 900 may don the backpack 200 by placing the backpack 200 on their back with their arms through the pair of straps 205. The user 900 may deploy the protective cover by grasping the deployment handle 324 and pulling it to actuate the deployment latch 332. When the deployment latch 332 is actuated, the shaft 314 may be released from the deployment latch 332 and the deployment spring 330 may cause the umbrella 310 to elevate and open. As the umbrella 310 opens, the curtain 370 may begin to fall from the periphery of the dome 312 until the user 900 is surrounded by a clear, flame retardant shield.

The user 900 may grasp the face mask 256 and place it on their face, covering their nose and mouth. As the user 900 breathes, the pressure regulator 258 may pass the breathable gas from within the air tank 252 to the face mask 256 at a regulated pressure.

If the user 900 encounters flames in their path as they exit the burning building, the user 900 may actuate the extinguisher trigger 230 to release the fire-suppressing substance 950 from the extinguisher tank 222 via the extinguisher nozzle 226.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, a "backpack" is an item of luggage that comprises a harness arrangement that allows the backpack to be carried on the back of a user. The harness arrangement commonly comprises a plurality of shoulder straps.

As used in this disclosure, a "canopy" is a cover, usually made of fabric that is placed above an area and creates a protected area within which people or objects are protected from the environment.

In this disclosure, "compressed air" refers to air that has been compressed to a pressure greater than atmospheric pressure.

As used in this disclosure, "concave" is used to describe a surface that resembles the interior surface of a sphere or a portion thereof.

As used herein, the words "couple", "couples", "coupled" or "coupling", refer to connecting, either directly or indirectly, and does not necessarily imply a mechanical connection.

As used in this disclosure, the terms "distal" and "proximal" may be used to describe relative positions. Distal refers to the object, or the end of an object, that is situated away from the point of origin, point of reference, or point of attachment. Proximal refers to the object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point or a central axis of an object and the direction of comparison may be in a radial or lateral direction.

As used in this disclosure, the word "exterior" is used as a relational term that implies that an object is not located or contained within the boundary of a structure or a space.

As used herein, "flame retardant" refers to an object that has been chemically treated to afford the object some resistance to igniting or to the chemical used to treat and object.

As used herein, "front" indicates the side of an object that is closest to a forward direction of travel under normal use of the object or the side or part of an object that normally presents itself to view or that is normally used first. "Rear" or "back" refers to the side that is opposite the front.

As used in this disclosure, a "handle" is an object by which a tool, object, or door is held or manipulated with the hand.

As used in this disclosure, "horizontal" is a directional term that refers to a direction that is perpendicular to the local force of gravity. Unless specifically noted in this disclosure, the horizontal direction is always perpendicular to the vertical direction.

As used herein, the word "hose" is intended to include hoses, tubing, piping, and other conduits capable of directing a flow of a gas or a liquid. When referring to a hose in this disclosure, the terms inner diameter and outer diameter are used as they would be used by those skilled in the plumbing arts.

As used in this disclosure, a "housing" is a rigid casing that encloses and protects one or more devices.

As used in this disclosure, the word "interior" is used as a relational term that implies that an object is located or contained within the boundary of a structure or a space.

As used in this disclosure, a "latch" is a fastening or locking mechanism. The use of the term latch may imply the insertion of an object into a notch or cavity. The act of latching may involve a linear, pivoting, or rotating motion.

As used here, the word "midpoint" refers to a point near the center of an object. An "exact midpoint" refers to a midpoint that is equidistant from edges of the object in at least one direction. Unless otherwise stated, a midpoint is not required to be at the exact center of the object but instead may be within 50% of the distance from the exact midpoint to the farthest edge or farthest corner.

As used herein, the word "portable" refers to a device that may be carried by a single person and may be used at multiple locations. In some cases, portable may imply that the device may be used while being carried.

As used in this disclosure, a "runner" is a component of an umbrella that fits over the center post of the umbrella. Stretchers are used to connect the ribs of the umbrella to the runner which in turn connects the runner to the center post. By raising the runner, the stretchers expand the ribs to create a structure upon which the canopy of the umbrella is placed.

As used in this disclosure, the term "shaft" is used to describe a rigid cylinder that is often used as the handle of a tool or implement or as the center of rotating machinery or motors. The definition of shaft explicitly includes solid shafts or shafts that comprise a hollow passage through the shaft along the center axis of the shaft cylinder, whether the shaft has one or more sealed ends or not.

As used in this disclosure, a "spring" is a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used in this disclosure, "telescopic", "telescoping", and "telescopically" refer to an object made of sections that fit or slide into each other such that the object can be made longer or shorter by adjusting the relative positions of the sections.

As used in this disclosure, a "trigger" is a lever that operates in conjunction with a spring or similar device such that: 1) the lever is used to activate a mechanism; and 2) the spring or similar device returns the lever to its original position after the mechanism has been activated.

As used in this disclosure, a "valve" is a device that is used to control the flow of a fluid, either gas or liquid, through a pipe or to control the flow of a fluid into and out of a container. Some valves may have multiple ports and may allow the diverting or mixing of fluids.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A portable fire safety enclosure system comprising:

a backpack, a protective cover, an extinguisher, and a breathing apparatus;

wherein the backpack is adapted to be worn by a user to protect the user while the user exits a burning building;

wherein the protective cover is deployed from within the backpack to prevent contact with burning materials;

wherein the extinguisher is activated to extinguish flames that prevent exit from the burning building;

wherein the breathing apparatus is adapted to provide a breathable gas to the user;

wherein the backpack is an enclosure for the protective cover, the extinguisher, and the breathing apparatus;

wherein the backpack is adapted to be donned during a fire emergency;

wherein the backpack is adapted to be worn by sliding the user's arms through a pair of straps and allowing the backpack to rest against the user's back;

wherein the pair of straps are coupled to the exterior of the backpack on the rear of the backpack;

wherein one of the pair of straps couples to the top of the left rear side of the backpack and to the bottom of the left rear side of the rear of the backpack;

wherein the other of the pair of straps couples to the top of the right rear side of the backpack and to the bottom of the right rear side of the rear of the backpack;

wherein the protective cover comprises an umbrella, a curtain, and an umbrella housing;

wherein the protective cover is adapted to reside within the backpack until the user deploys the protective cover my pulling a deployment handle;

wherein the protective cover deploys by extending the umbrella from the top of the backpack, opening the umbrella, and releasing the curtain;

wherein once deployed, the protective cover is adapted to surround the user with a clear, protective shield.

2. The portable fire safety enclosure system according to claim 1 wherein the umbrella comprises a dome, a shaft, a plurality of ribs, a plurality of stretchers, and a runner;

wherein the umbrella is a collapsible canopy that is adapted to protect the user from objects falling from above.

3. The portable fire safety enclosure system according to claim 2 wherein the shaft, the plurality of ribs, the plurality of stretchers, and the runner, comprise a frame for the umbrella;

wherein the shaft is a vertically-oriented armature that elevates the dome above the backpack;

wherein the shaft is telescoping such that the overall height of the shaft is reduced when a first section of the shaft slides into a second section of the shaft.

4. The portable fire safety enclosure system according to claim 3 wherein the plurality of ribs radiate outward horizontally from the top of the shaft to support the dome;

wherein the plurality of ribs are hingedly coupled to the top of the shaft and are equally spaced around the shaft;

wherein each of the plurality of ribs bend in a downward arc to give the dome a concave shape when viewed from above the dome.

5. The portable fire safety enclosure system according to claim 4 wherein the runner is a ring that surrounds the shaft and is free to slide up and down the shaft;

wherein the plurality of stretchers radiate outward from the runner;

wherein there is one of the plurality of stretchers for each of the plurality of ribs;

wherein each of the plurality of stretchers are hingedly coupled to the runner at one end and hingedly coupled to a midpoint one of the plurality of ribs at the other end.

6. The portable fire safety enclosure system according to claim 5 wherein the dome is a circular sheet of material that couples to the outermost end of each of the plurality of ribs around the periphery of the dome;

wherein the shaft passes through the center of the dome and the dome is coupled to the top of the shaft at that point.

7. The portable fire safety enclosure system according to claim 6 wherein the curtain is a sheet of material formed into a hollow, vertically-oriented tube that is open at the top and bottom of the tube;

wherein the top of the curtain is coupled to the periphery of the dome.

8. The portable fire safety enclosure system according to claim 7 wherein the dome and the curtain are clear to provide a view of the outside of the portable fire safety enclosure system from within the portable fire safety enclosure system;

wherein the dome and the curtain are treated to make them flame retardant.

9. The portable fire safety enclosure system according to claim 8 wherein the umbrella housing is a cylindrical tube that is coupled to the inside of the backpack;

wherein the umbrella housing is vertically oriented with the top of the umbrella housing extending out of the top of the backpack;

wherein the umbrella housing encloses the umbrella and the curtain when that are not deployed;

wherein the curtain is rolled upwards until it is adjacent to the umbrella, the umbrella is collapsed by pressing down on the distal ends of the plurality of ribs and sliding the runner down the shaft, and the umbrella with the curtain is pushed down into the umbrella housing.

10. The portable fire safety enclosure system according to claim 9 wherein the umbrella comprises a deployment spring and a deployment latch;

wherein the deployment spring causes the shaft to elevate and causes the dome to open, thus deploying the umbrella;

wherein the deployment latch retains the umbrella in the non-deployed position until the deployment latch is actuated;

wherein the deployment latch is actuated by pulling a deployment cord via the deployment handle.

11. The portable fire safety enclosure system according to claim 10 wherein one end of the deployment spring is coupled to the runner and the other end of the deployment spring is coupled to the interior of the umbrella housing such that the deployment spring causes the runner of the umbrella to rise;

wherein the runner is initially located at the bottom of the shaft;

wherein as the runner rises, the runner causes the umbrella to open by pushing outwards against the plurality of stretchers;

wherein the deployment latch is located at the bottom of the umbrella housing and holds the shaft down until the deployment latch is released.

12. The portable fire safety enclosure system according to claim 11 wherein the deployment cord passes through a side wall of the backpack such that the deployment cord extends from the interior of the backpack to the exterior of the backpack;

wherein the interior end of the deployment cord is coupled to the deployment latch and the exterior end of the deployment cord is coupled to the deployment handle such that pulling the deployment cord releases the deployment latch and causes the shaft to move upwards.

13. The portable fire safety enclosure system according to claim 12 wherein the extinguisher comprises an extinguisher tank, an extinguisher hose, an extinguisher nozzle, an extinguisher trigger cable, and an extinguisher trigger;

wherein the extinguisher discharges a fire-suppressing substance through the extinguisher nozzle when the extinguisher is activated using the extinguisher trigger.

14. The portable fire safety enclosure system according to claim 13 wherein the extinguisher tank is a container for the fire-suppressing substance;

wherein the extinguisher tank is carried within the backpack;

wherein the extinguisher hose couples to the extinguisher tank via an extinguisher valve;

wherein the fire-suppressing substance is retained in the extinguisher tank when the extinguisher valve is closed and flows out of the extinguisher tank and through the extinguisher hose when the extinguisher valve is open;

wherein the extinguisher valve is opened by actuating the extinguisher trigger;

wherein the actuation of the extinguisher trigger is conveyed to the extinguisher valve via the extinguisher trigger cable;

wherein the extinguisher nozzle is located on the top of the shaft above the dome and points forward such that when the fire-suppressing substance is discharged the fire-suppressing substance extinguishes flames in front of the user;

wherein the shaft is hollow and the extinguisher hose passes through the hollow center of the shaft;

wherein the fire-suppressing substance from the extinguisher tank passes through the extinguisher hose to reach the extinguisher nozzle which is coupled to the top of the shaft.

15. The portable fire safety enclosure system according to claim 14 wherein the breathing apparatus comprises an air tank, a pressure regulator, an air hose, and a face mask;

wherein the air tank is a container for the breathable gas.

16. The portable fire safety enclosure system according to claim 15 wherein the breathable gas is compressed air or oxygen;

wherein the air tank is carried within the backpack;

wherein the pressure regulator couples to the air tank and is adapted to reduce the pressure of the breathable gas that is inside the air tank to a lower pressure that is safe for the user to breathe;

wherein the air hose delivers the breathable gas from the pressure regulator to the face mask;

wherein the face mask is adapted to be placed over the nose and mouth of the user such that the user breathes the breathable gas while leaving the burning building.

* * * * *